US005307849A

United States Patent [19]

Nelson

[11] Patent Number: 5,307,849

[45] Date of Patent: May 3, 1994

[54] AIR CONDITIONER COVER

[76] Inventor: Dennis R. Nelson, 842 Houseman Ave., NW., Grand Rapids, Mich. 49503

[21] Appl. No.: 910,682

[22] Filed: Jul. 8, 1992

[51] Int. Cl.[5] ..... B65D 85/68

[52] U.S. Cl. ..... 150/165; 62/DIG. 13; 237/79

[58] Field of Search ..... 150/165, 154; 62/506, 62/507, DIG. 13; 237/79; 220/902

[56] References Cited

U.S. PATENT DOCUMENTS

| | | | |
|---|---|---|---|
| 2,711,769 | 6/1955 | Katcher et al. . | |
| 2,720,236 | 10/1955 | Hoffman . | |
| 2,992,668 | 7/1961 | Collard . | |
| 3,320,996 | 5/1967 | Singer . | |
| 4,202,389 | 5/1980 | Ewald . | |
| 4,308,905 | 1/1982 | Gallagher . | |
| 4,323,167 | 4/1982 | Zirn et al. | 220/902 X |
| 4,376,082 | 3/1983 | Heck | 62/DIG. 16 |
| 4,498,912 | 2/1985 | Wagner | 62/DIG. 16 |
| 4,625,784 | 12/1986 | Boroson . | |
| 4,732,012 | 3/1988 | Thorpe | 62/DIG. 16 |
| 4,745,769 | 5/1988 | Wooden, Jr. | 62/DIG. 16 |
| 4,747,505 | 5/1988 | Hansen | 62/DIG. 16 |
| 4,811,767 | 3/1989 | Kessler | 150/954 |
| 4,815,530 | 3/1989 | Scott | 62/507 X |
| 5,048,710 | 9/1991 | Diston | 150/165 X |
| 5,097,678 | 3/1992 | Aubuchon . | |

FOREIGN PATENT DOCUMENTS

| | | | |
|---|---|---|---|
| 1502737 | 10/1967 | France | 150/154 |

*Primary Examiner*—Allan N. Shoap
*Assistant Examiner*—Christopher McDonald
*Attorney, Agent, or Firm*—Warner, Norcross & Judd

[57] ABSTRACT

A cover for the outdoor unit of a split-system air conditioner is disclosed having a flexible shroud and a resilient protective panel disposed in the top of the shroud to protect the top of the unit against damage from falling objects. The protective panel may be formed with a downwardly opening recess covered by a rigid insert panel to provide added protection for the air conditioner motor mount, vanes or grille, or to provide clearance for upwardly projecting parts. A rigid cap panel coextensive with the resilient panel may also be used. The protective panel is retained within the top of the shroud by a retainer skirt having an elastic free edge extending below the perimeter of the protective panel.

10 Claims, 2 Drawing Sheets

AIR CONDITIONER COVER

BACKGROUND OF THE INVENTION

1. Field of the Invention

The present invention relates to an air conditioner cover and, more particularly, to a protective cover for an outdoor air conditioner unit.

2. Description of the Related Art

Split-system air conditioners are widely used in which an outdoor unit houses the compressor, condenser, fan, and control components. The outdoor unit is installed near the exterior of the building in which the evaporator is located. Protective covers for outdoor units are known in which a shroud of flexible, weather resistant material envelops the outdoor unit to protect against the weather, moisture, dirt, leaf particles, and other debris when the unit is not in use.

Outdoor units of split-system air conditioners are frequently located beneath the eaves of buildings. In this situation, the units are susceptible to damage from ice and other hard objects falling from the eaves. Since the fan motor of an outdoor unit is frequently mounted to the underside of the top panel of the unit, the fan motor is particularly susceptible to damage. Furthermore, the top panel is usually formed with fins or a grille which are also easily damaged by falling objects. Therefore, it is desirable for an air conditioner cover to be capable of protecting against such damage from hard, falling objects.

SUMMARY OF THE INVENTION

The present invention provides a cover for an outdoor air conditioner unit having a protective top panel. According to a preferred embodiment, the cover includes a flexible, downwardly opening shroud and a resilient panel coextensive with the top portion of the shroud and with the top panel of the air conditioner unit. The impact of falling objects is absorbed and distributed by the resilient panel to prevent damage to the top of the air conditioner unit and to the internals of the unit.

According to a feature of the invention, the resilient panel may be formed with a recess in its underside coinciding with the portion of the top panel of the air conditioner unit to which the fan motor may be mounted. The recess protects against damage to the fan motor and to any vanes or grille surrounding the fan motor. The recess further provides clearance for any components protruding upwardly from the top panel of the air conditioner unit.

According to another feature, the inner top portion of the flexible shroud is provided with a retainer skirt forming an interior pocket in which the protective panel is held. The free edge of the retainer skirt is elastic in order to permit easy installation, removal, and replacement of the protective panel.

According to other features, the protective top panel of the cover may include a rigid insert panel covering the recess of the resilient panel. Alternatively, the protective top panel may include a rigid cap panel covering the entirety of the resilient panel with or without the rigid insert panel.

These and other objects, advantages, and features of the present invention will be more fully understood and appreciated by reference to the written specification and appended drawings.

DESCRIPTION OF THE PREFERRED EMBODIMENT

Figure 1:
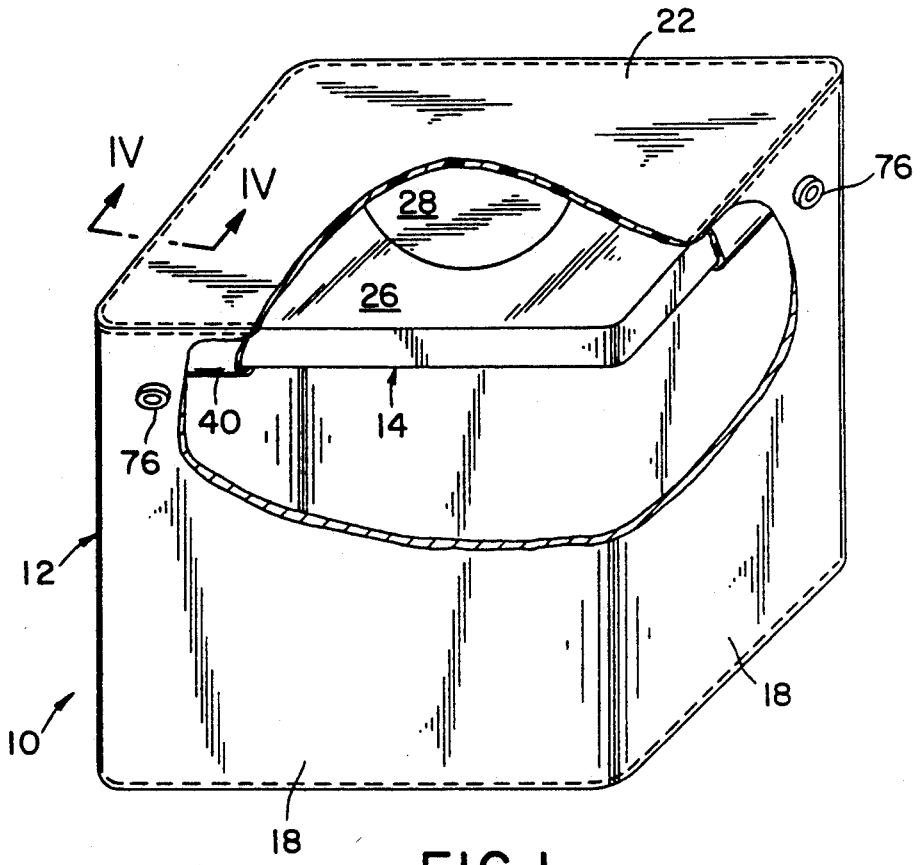
FIG. 1 is a perspective view of an air conditioner cover according to the principles of the invention with parts of the shroud cut away to reveal the protective top panel.
Figure 2:
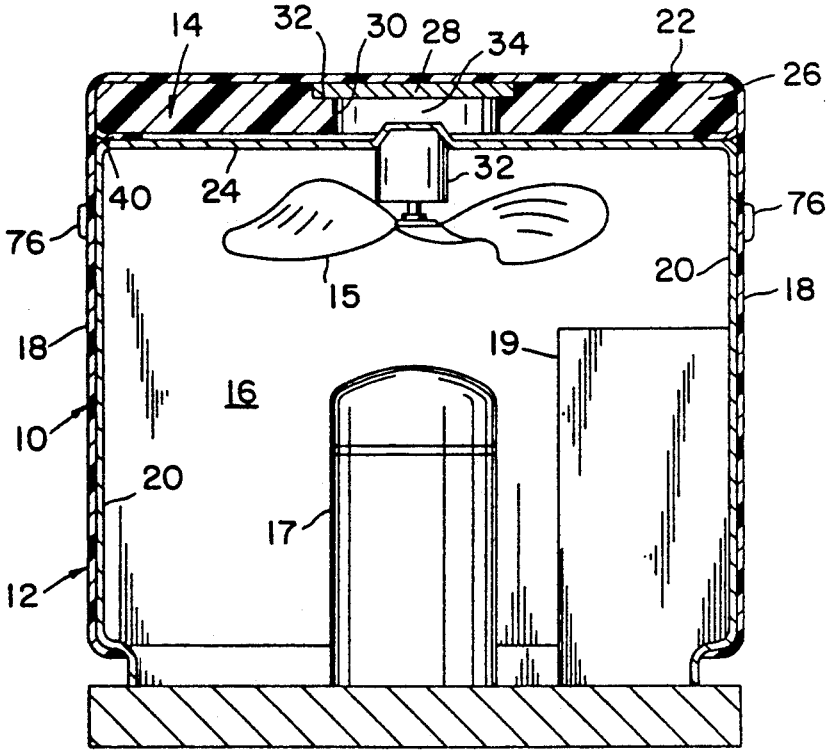
FIG. 2 is a vertical sectional view of the air conditioner cover of FIG. 1 positioned on an outdoor air conditioner unit.

By way of disclosing a preferred embodiment, and not by way of limitation, there is shown in FIGS. 1 and 2 an air flexible, downwardly opening shroud 12 and a protective top panel 14 retained within the upper portion of the shroud. The shroud defines a cavity in which is received an outdoor air conditioner unit 16. The air conditioner cover shown is configured for a rectangular outdoor air conditioner unit 16 which houses a fan 15, a compressor 17, a condenser 19 and other components. However, the cover may also be configured to fit a cylindrical unit, or other shapes, as will be readily appreciated by those skilled in the art.

The shroud 12 is made of a flexible and weather resistant material such as woven nylon fabric. The shroud 12 includes a top portion 22 which extends above the top 24 of the unit 16. The shroud further includes side portions 18 depending from the perimeter of the top portion 22. Side portions 18, which are sewn along their upper edges to the perimeter of the top portion 22, overlie and cover the side panels 20 of the unit 16.

Figure 3:
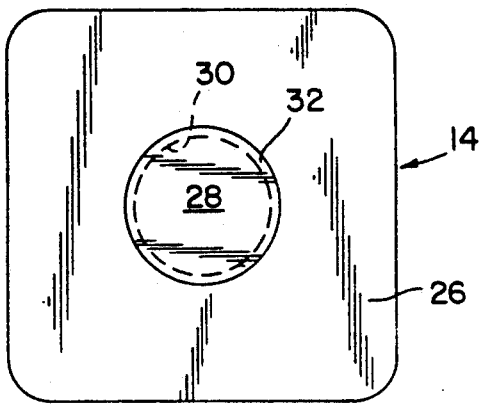
FIG. 3 is a plan view of the protective top panel of FIG. 1.

Referring also to FIG. 3, it may be seen that the protective top panel 14 is an assembly of a generally rectangular resilient board or panel 26 and a rigid circular insert panel 28. In plan, the resilient panel 26 is coextensively of the same size and shape as the top 24 of the outdoor air conditioner unit 16. A central portion of the resilient panel 26 is formed with a circular hole 30 which surrounds the portion of the unit top to which the fan motor 31 is mounted. The upper perimeter of the hole 30 is formed with a rabbet which thus provides a downwardly recessed ledge 32. Rigid insert panel 28, having a diameter substantially equal to the outer diameter of the ledge 32, is inserted in the top of the hole 30 resting atop the ledge 32. Suitable adhesive is used to secure the underside of the rigid insert panel 28 to the ledge 32.

As best shown in FIG. 3, rigid insert panel 28 and resilient panel 26 cooperatively form a downwardly opening recess 34 in the protective top panel 14. The recess 34 is aligned with the portion of the unit top 24 to which the fan motor 31 is mounted. With this arrangement, the fan motor 32 is protected against impact from falling objects. The impact of an object falling on the rigid insert panel 28 is carried through the rigid insert panel to the resilient panel 26. The resilient panel absorbs the force of the impact and distributes the load harmlessly over the top 24 of the unit 16.

The recess 34 may also coincide with any portions of the outdoor air conditioner unit 16 protruding above the unit top 24. Furthermore, the recess 34 may also encircle any vanes or grille which might otherwise be easily damaged.

A suitable material for the resilient panel 26 is two inch thick closed cell polyethylene foam board. The rigid insert panel 28 may be made of plywood.

Figure 4:
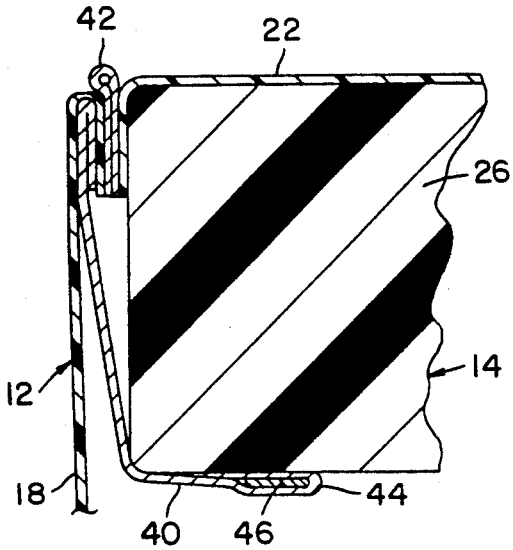
FIG. 4 is a sectional view taken along the line IV—IV of FIG. 1 with fabric thickness exaggerated for clarity of illustration.

As shown in FIGS. 1, 2, and 4, the shroud 12 includes a sewn-in retainer skirt 40 which surrounds the protective panel and extends under the perimeter of the protective top panel 14. The retainer skirt may be made of the same fabric as the rest of the shroud. As best shown in FIG. 4, the retainer skirt 40, side portions 18, and top portion 22 of the shroud are sewn together along with a welting 42 at the juncture of the side portions and top portion. The free lower edge 44 of the retainer skirt 40 is sewn to an elastic band 46. The elastic band draws the free edge 44 of the retainer skirt 40 inward, thus forming a pocket between the skirt 40 and the top portion 22.

The protective top panel 26 is retained within the pocket defined by the retainer skirt 40 and the top portion 22. The elastic band 46 permits the protective top panel to be easily installed, removed, and replaced.

Figure 5:
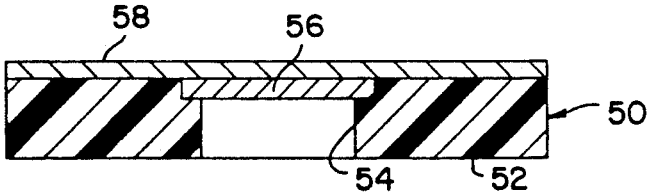
FIG. 5 is a sectional view of a first alternate embodiment of the protective top panel.
Figure 6:
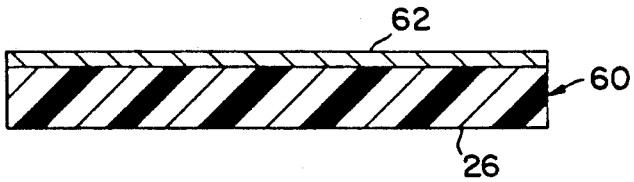
FIG. 6 is a sectional view of a second alternate embodiment of the protective top panel.
Figure 7:
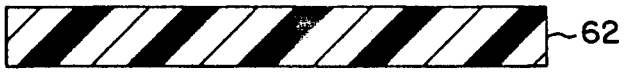
FIG. 7 is a sectional view of a third alternate embodiment of the protective top panel.

Alternate embodiments of the protective top panel are shown in FIGS. 5–7.

Protective top panel 50, shown in FIG. 5, is similar to protective top panel 14, having a resilient panel 52 with a central recess 54 and a rigid insert panel 56 covering the recess. In addition, protective top panel 50 includes a rigid cap panel 58 covering the entire upper surface of the combined resilient panel 52 and rigid insert panel 56. Suitable adhesive is used to adhere the cap panel 58 to one or both of the resilient panel 52 and the insert panel 56. This construction is particularly suited for use beneath the eaves of buildings having two or more stories. The rigid cap panel provides an added degree of protection against damage from objects falling from a greater height.

In the embodiment of FIG. 6, the protective top panel 60 is an assembly of a resilient board or panel 62 and a rigid cap panel 62 overlying and coextensive with the top surface of the resilient panel 62. A recess is absent. This embodiment is suitable for use when it is not necessary to protect a motor mounting, vanes, or grille, or to accommodate protrusions, yet it is desirable to protect against damage from objects falling from a greater height.

In the embodiment of FIG. 7, the protective top panel is a single board or panel 62 of resilient or rigid material. This embodiment is suitable for use when a recess is not necessary and the impact of falling objects is not sufficient to require an additional cap panel.

Figure 8:
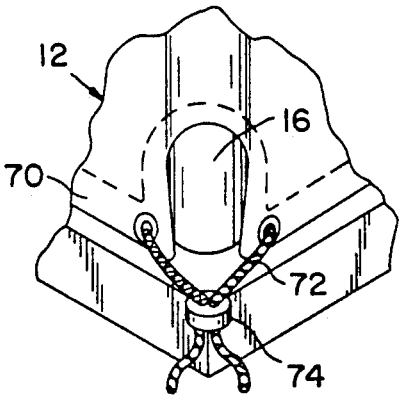
FIG. 8 is a fragmentary perspective view of the vent and drawstring of the air conditioner cover positioned on an outdoor air conditioner unit.

As shown in FIG. 8, the lower edge of the shroud is formed with a hem 70 through which passes a drawstring 72. The ends of the drawstring pass through a clamp 74. The drawstrings are used to tighten the lower edge of the shroud around the bottom of the outdoor air conditioner unit 16. As shown in FIGS. 1 and 2, the side portions 18 of the shroud are fitted with grommets 76 which encircle ventilation openings.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. An air conditioner cover comprising:

a flexible shroud;

a protective panel retained within the shroud and adapted to overlie the top of an air conditioner unit, said protective panel formed with a downwardly opening recess;

a first rigid panel overlying at least said downwardly opening recess; and a second rigid panel overlying said first rigid panel and said protective panel.

2. An air conditioner cover comprising:

a downwardly opening shroud of flexible material having a top portion and side portions depending from said top portion, the area within said shroud adjacent said top portion forming an upper portion, said side portions of said flexible shroud having a length sufficient to overlie the side of an air conditioning unit; and a protective panel retained within said supper portion of said shroud and adapted to overlie the top of an air conditioner unit, said protective panel formed with a downwardly opening recess, said protective panel including a generally planar upper surface, said protective panel further including a first rigid panel insert overlying at least said downwardly opening recess and being flush with or below said upper surface of said protective panel.

3. An air conditioner cover comprising:

a downwardly opening shroud of flexible material having a top portion and side portions depending from said top portion, the area within said shroud adjacent said top portion forming an upper portion;

a protective panel retained within said upper portion of said shroud and adapted to overlie the top of an air conditioner unit, said protective panel formed with a downwardly opening recess, said protective panel including a first rigid panel overlying at least said downwardly opening recess, said protective panel further including a second rigid panel overlying said first rigid panel and said protective panel.

4. An air conditioner cover comprising:

a downwardly opening shroud of flexible material having a top portion and side portions depending from said top portion, the area within said shroud adjacent said top portion forming an upper portion, said side portions of said flexible shroud having a length sufficient to overlie the side of an air conditioning unit;

a protective panel retained within said upper portion of said shroud and adapted to overlie the top of an air conditioner unit; and a rigid cap panel coextensively overlying said protective panel.

5. An air conditioner cover comprising:

a downwardly opening shroud of flexible material having a top portion and side portions depending from said top portion, the area within said shroud adjacent said top portion forming an upper portion, said side portions of said flexible shroud having a length sufficient to overlie the side of an air conditioning unit; and a protective panel retained within said upper portion of said shroud and adapted to overlie the top of an air conditioner unit, said shroud formed with a pocket for retaining said protective panel.

6. The air conditioner cover of claim 5 wherein said shroud includes a retainer skirt having an elastic free edge extending inwardly below the perimeter of said protective panel, said pocket being defined above said retainer skirt.

7. An air conditioner comprising:

a flexible shroud having a top portion and side portions depending from said top portion defining a cavity for receiving completely an air conditioner unit;

a retainer means disposed in said cavity beneath said top portion;

a resilient protective panel retained in said cavity by said retainer means beneath said top portion, said protective panel being overlyingly coextensive with the top of an air conditioner unit received in said cavity, said resilient protective panel formed with a central hole and including a generally planar upper surface; and a rigid panel insert covering said hole, thereby forming a downwardly opening recess in said protective panel, said insert being flush with or below said upper surface of said protective panel.

8. An air conditioner cover comprising:

a flexible shroud having a top portion and side portions depending from said top portion defining a cavity for receiving an air conditioner unit;

a retainer means disposed in said cavity beneath said top portion;

a resilient protective panel retained in said cavity by said retainer means beneath said top portion, said protective panel being overlyingly coextensive with the top of an air conditioner unit received in said cavity, said protective panel formed with a central hole, said resilient protective panel formed with a recessed ledge surrounding said central hole; and a rigid panel insert covering said hole and resting upon said ledge, thereby forming a downwardly opening recess in said protective panel.

9. The air conditioner cover of claim 8 further comprising a rigid cap panel coextensively overlying said protective panel and said rigid panel insert.

10. An air conditioner cover comprising:

a flexible shroud having a top portion and side portions depending from said top portion defining a cavity for receiving completely an air conditioner unit;

a retainer means disposed in said cavity beneath said top portion;

a resilient protective panel retained in said cavity by said retainer means beneath said top portion, said protective panel being overlyingly coextensive with the top of an air conditioner unit received in said cavity; and a rigid cap panel coextensively overlying said protective panel.

* * * * *